US006679135B1

(12) United States Patent
Faigle et al.

(10) Patent No.: US 6,679,135 B1
(45) Date of Patent: Jan. 20, 2004

(54) ENERGY ABSORBING BRAKE PEDAL

(75) Inventors: Ernst M. Faigle, Dryden, MI (US); Thomas Osentoski, Marysville, MI (US); Tracy S. Sparks, Attica, MI (US)

(73) Assignee: TRW Vehicle Safety Systems Inc., Lyndhurst, OH (US)

( * ) Notice: Subject to any disclaimer, the term of this patent is extended or adjusted under 35 U.S.C. 154(b) by 0 days.

(21) Appl. No.: 09/661,943

(22) Filed: Sep. 14, 2000

(51) Int. Cl.[7] ..... G05G 1/14
(52) U.S. Cl. ..... 74/512; 74/560
(58) Field of Search ..... 74/560, 512, 513

(56) References Cited

U.S. PATENT DOCUMENTS

| | | | | | |
|---|---|---|---|---|---|
| 3,988,027 | A | | 10/1976 | Serizawa et al. | 280/87 C |
| 5,033,267 | A | * | 7/1991 | Keane | 60/594 |
| 5,549,837 | A | * | 8/1996 | Ginder et al. | 252/62.52 |
| 5,632,184 | A | | 5/1997 | Callicutt et al. | 74/512 |
| 5,695,214 | A | | 12/1997 | Faigle et al. | 280/735 |
| 5,848,558 | A | | 12/1998 | Isono et al. | 74/512 |
| 5,865,510 | A | * | 2/1999 | Poertzgen et al. | 303/113.4 |
| 6,070,489 | A | | 6/2000 | Ananthasivan et al. | |
| 6,279,952 | B1 | * | 8/2001 | Van Wynsberghe et al. | 280/777 |
| 6,290,018 | B1 | * | 9/2001 | Mebus | 180/274 |
| 6,309,031 | B1 | * | 10/2001 | Crombez et al. | 303/113.4 |
| 6,324,453 | B1 | * | 11/2001 | Breed et al. | 701/45 |

FOREIGN PATENT DOCUMENTS

| | | | | |
|---|---|---|---|---|
| DE | 3431823 | * | 3/1986 | 60/548 |

OTHER PUBLICATIONS

Anonymous, Magneto–rheological elastomeric pedal feel emulator, RD–408099, Apr. 1998, Derwent Information Ltd.*

* cited by examiner

*Primary Examiner*—Thomas R. Hannon
*Assistant Examiner*—Vicky A. Johnson
(74) *Attorney, Agent, or Firm*—Tarolli, Sundheim, Covell & Tummino L.L.P.

(57) ABSTRACT

An apparatus (10) for actuating a braking system of a vehicle (12) comprises a brake pedal (30) and an actuating member (36) movable to actuate the braking system. A release mechanism (40) is connected between the brake pedal (30) and the actuating member. The release mechanism (40) has a first condition connecting the actuating member (36) for movement with the brake pedal (30). The release mechanism (40) has a second condition releasing the brake pedal (30) for movement relative to the actuating member (36) under load applied to the brake pedal by the vehicle occupant. The release mechanism (40) when in the second condition resists movement of the brake pedal (30) relative to the actuating member (36). The apparatus (10) further comprises at least one sensor (14, 16) operative to sense a vehicle condition or an occupant condition and to provide a first output signal. A controller (20) receives the first output signal and in response controls the release mechanism (40) to control the resistance of the release mechanism to movement of the brake pedal (30) relative to the actuating member (36).

45 Claims, 3 Drawing Sheets

ENERGY ABSORBING BRAKE PEDAL

BACKGROUND OF THE INVENTION

1. Technical Field

The present invention relates to an energy absorbing brake pedal for a vehicle, which can reduce the load on a vehicle occupant in the event of a vehicle collision.

2. Description of the Prior Art

It is known to provide a "break-away" brake pedal assembly in a vehicle. This type of brake pedal assembly has parts that move relative to each other, under sufficient load from the foot of the vehicle driver. Such movement can help to absorb energy, lessening the possibility of driver injury, in the event of a vehicle collision.

It is also known to use one or more explosive bolts to support a vehicle steering column. In the event of a vehicle collision, the explosive bolts are actuated to release the steering column. The steering column is released to pivot downward, under the force of gravity, to move the steering wheel out of the path of forward movement of the occupant's head and chest.

It is also known to use electrorheological fluid in an energy absorber for an engine mount or for other another vehicle structure having two relatively movable parts. Varying the strength of an energy field acting on the fluid can vary the apparent viscosity or shear strength of the fluid, thus controlling the energy absorption characteristics of the device.

SUMMARY OF THE INVENTION

The present invention is an apparatus for actuating a braking system of a vehicle. The apparatus comprises a brake pedal supported on the vehicle for movement between a plurality of positions and engageable by a foot of the vehicle occupant to effect actuation of the braking system. The apparatus also comprises an actuating member movable to actuate the braking system, and a release mechanism connected between the brake pedal and the actuating member. The release mechanism has a first condition connecting the actuating member for movement with the brake pedal. The release mechanism has a second condition releasing the brake pedal for movement relative to the actuating member under load applied to the brake pedal by the vehicle occupant. The release mechanism when in the second condition resists movement of the brake pedal relative to the actuating member. The apparatus further comprises at least one sensor operative to sense a vehicle condition or an occupant condition and to provide a first output signal. A controller receives the first output signal and in response controls the release mechanism to control the resistance of the release mechanism to movement of the brake pedal relative to the actuating member.

BRIEF DESCRIPTION OF THE DRAWINGS

Further features of the present invention will become apparent to those skilled in the art to which the present invention relates from reading the following specification with reference to the accompanying drawings, in which.

DETAILED DESCRIPTION OF EMBODIMENTS OF THE INVENTION

Figure 1:
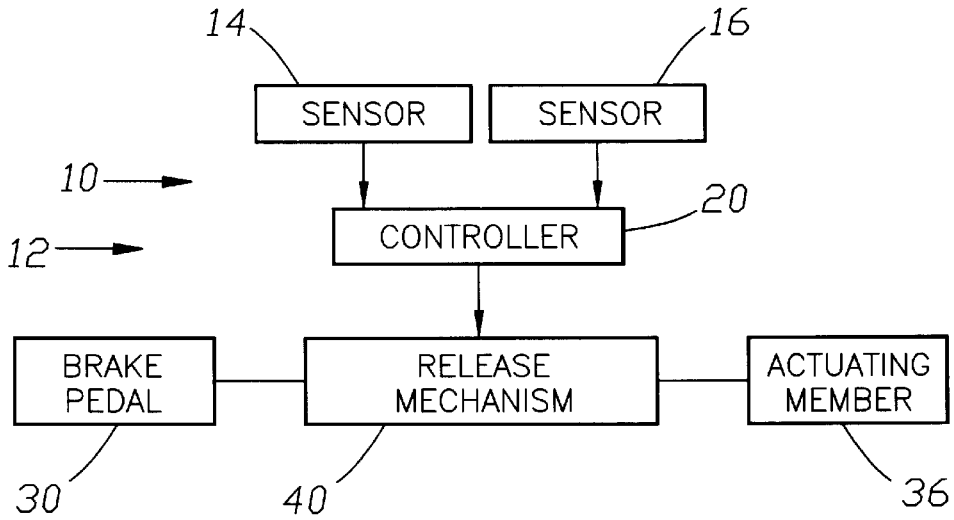
FIG. 1 is a functional block diagram of an apparatus for actuating a braking system of a vehicle.
Figure 2:
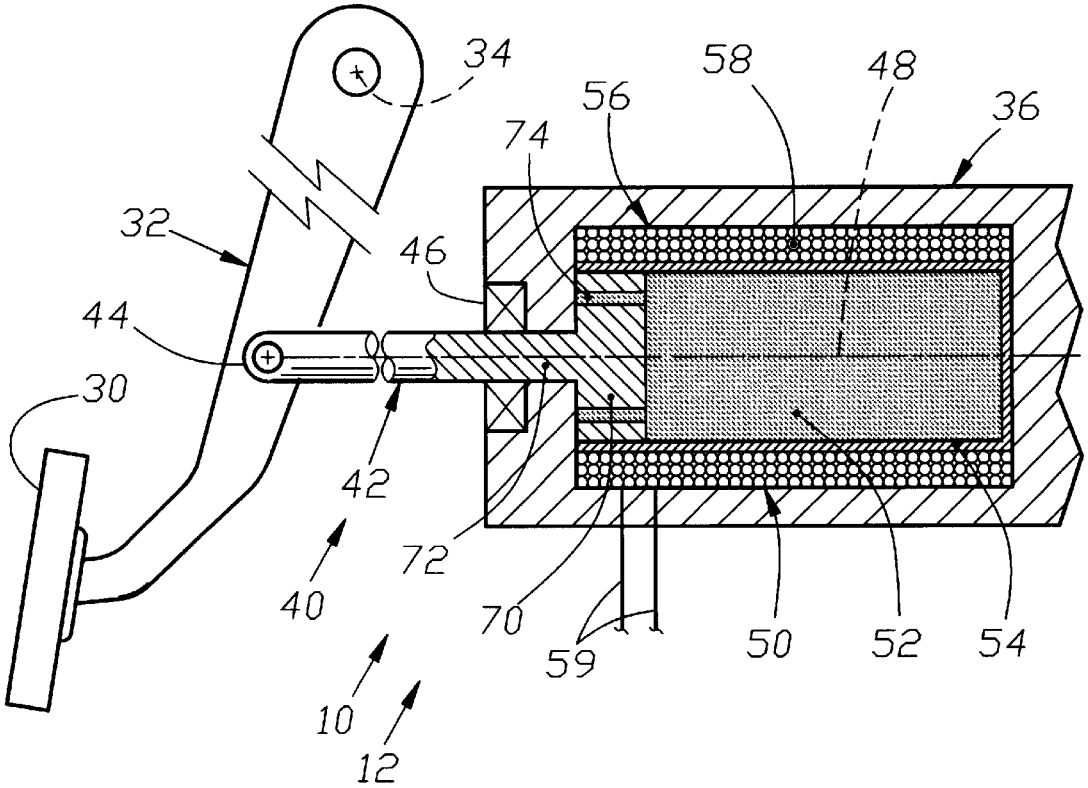
FIG. 2 is a schematic side view of a portion of the apparatus of FIG. 1 in accordance with a first embodiment of the invention.

The present invention relates to an apparatus for actuating a braking system of a vehicle that can reduce the load on a vehicle occupant in the event of a vehicle collision. As representative of the present invention, FIGS. 1 and 2 illustrate an apparatus 10 for actuating a braking system of a vehicle. The apparatus 10 is part of a vehicle 12.

The apparatus 10 includes one or more vehicle condition sensors indicated schematically at 14. The vehicle condition sensors 14 are known devices operative to sense vehicle conditions such as crash severity, sudden vehicle deceleration, an impact to the vehicle 12, or a rollover condition of the vehicle. The safety apparatus 10 also includes one or more occupant condition sensors indicated schematically at 16. The occupant condition sensors 16 are known devices operative to sense occupant conditions such as seat belt usage, size, weight, and/or position of a vehicle occupant, specifically, the driver of the vehicle 12.

The apparatus 10 includes programmable vehicle electric circuitry including at least one electronic control unit or controller indicated schematically at 20. The controller 20 is operative to receive and act on the output signals from the vehicle condition sensors 14 and the occupant condition sensors 16. In response to the output from the sensors 14 and 16, the controller 20 is operative, in a manner described below, to actuate a release mechanism 40. The release mechanism 40 includes an energy absorbing device 50. The release mechanism 40, when actuated, can help to protect a driver of the vehicle 12.

The apparatus 10 includes a brake pedal 30 fixedly supported on a brake lever 32. The brake lever 32 is supported on the vehicle 12 for pivotal movement relative to the vehicle about an axis 34. The brake pedal 30 is thus supported on the vehicle 12 for movement between a plurality of positions. The brake pedal 30 is engageable by a foot of the vehicle driver to effect actuation of the vehicle braking system, in a manner described below.

The apparatus 10 also includes an actuating member 36 movable to actuate the vehicle braking system. FIG. 2 shows a portion of the actuating member 36. The actuating member 36 is connected, in a manner not shown, with the vehicle braking system. When the actuating member 36 is moved in a direction to the right as viewed in FIG. 2, the vehicle braking system is actuated.

The release mechanism 40 is connected between the brake pedal 30 and the actuating member 36. The release mechanism 40 includes a cylindrical shaft 42. A first end portion 44 of the shaft 42 is connected with the brake lever 32 for pivotal movement relative to the brake lever. The pivotal connection between the shaft 42 and the brake lever 32 enables the shaft to move in a left to right direction as viewed in FIG. 2 upon the brake pedal 30 of the vehicle 12 being depressed. One or more bearings 46 in the actuating member 36 support the shaft for movement relative to the actuating member along an axis 48.

The energy absorbing device 50 of the release mechanism 40 is interposed between the shaft 42 and the actuating member 36. The energy absorbing device 50 helps to control movement of the shaft 42 relative to the actuating member 36 in a direction along the axis 48.

The energy absorbing device 50 includes a quantity of fluid 52. The viscosity of the fluid 52 can be varied by applying an energy field to the fluid. The fluid 52 is preferably a magneto-rheological fluid, the viscosity of which can be varied by controlling the strength of a magnetic field applied to the fluid. The fluid 52 can, alternatively, be an electrorheological fluid, the viscosity of which can be varied by controlling the strength of an electric field applied to the fluid. The fluid 52 is contained in a fluid cylinder 54 enclosed in the actuating member 36. The fluid cylinder 54 is centered on the axis 48.

The energy absorbing device 50 also includes a coil 56 that has a plurality of windings 58. The windings 58 extend around the fluid cylinder 54. The windings 58, when energized by an electric current over lead wires 59, generate a magnetic field, which extends through and acts on the fluid 52. The lead wires 59 are connected to the controller 16.

A piston 70 is located in the fluid cylinder 54. The piston 70 is fixed on a second end portion 72 of the shaft 42. The piston 70 is slidable in the cylinder 54 in a direction along the axis 48. A plurality of openings in the form of orifices 74 are formed in the piston 70. The orifices 74 establish fluid communication through the piston 70.

The fluid 52 resists axial sliding movement of the piston 70 in the cylinder 54. If the viscosity of the fluid 52 is low enough, the fluid in the cylinder 54 can flow through the orifices 74 in the piston 70, to enable the piston to move axially in the cylinder through the body of fluid. If the viscosity of the fluid 52 is high enough, the fluid in the cylinder 54 can not flow through the orifices 74 in the piston 70, thereby blocking sliding movement of the piston in the cylinder. Varying the viscosity of the fluid 52 thus varies the rate of flow of the fluid through the orifices 74 in the piston 70, thereby varying the resistance to movement of the piston, and the shaft 42, relative to the actuating member 36.

The controller 20 controls the operation of the energy absorbing device 50 in response to the outputs of the vehicle condition sensors 14 and the occupant condition sensors 16. Control of the energy absorbing device 50 may be responsive to the vehicle crash severity as sensed by the vehicle condition sensors 14. It may also be responsive to the size, weight, and/or position of the driver, or to any other factor which may be useful in determining how much resistance the energy absorbing device 50 should offer under load.

The release mechanism 40 has a first condition connecting the actuating member 36 for movement with the brake pedal 30. When the release mechanism is 40 in the first condition, the controller 20 energizes the coil 56 so as to keep the viscosity of the fluid 52 high. The high viscosity of the fluid 52 resists flow of the fluid through the orifices 74 in the piston 70. This resistance to flow prevents the piston 70 from moving in the cylinder 54, and thus prevents the shaft 42 from moving axially relative to the actuating member 36. As a result, when the vehicle driver depresses the brake pedal 30, the shaft 42 causes the actuating member 36 to move in a direction to actuate the vehicle braking system, that is, to the right as viewed in FIG. 2.

The release mechanism 40 has a second condition releasing the brake pedal 30 for movement relative to the actuating member 36 under load applied to the brake pedal by the vehicle occupant. Specifically, in the event of a crash condition involving sudden vehicle deceleration, the driver may move forward in the vehicle 12, relative to the parts of the vehicle including the brake pedal 30. Alternatively, the portion of the vehicle 12 supporting the brake pedal 30 may be deformed and driven rearward toward engagement with the driver's foot. In either event, the force applied between the driver's foot and the brake pedal 30 may cause injury to the driver's foot or leg if the brake pedal is unyielding.

In the event of such a crash condition, or other event for which protection of the vehicle driver may be desired, the sensors 14 and 16 provide appropriate output signals. The output signals are inputs to the controller 20 for the purpose of adjusting the viscosity of the fluid 52. The controller 20 determines, on the basis of these output signals, whether the preset viscosity of the fluid 52 is appropriate for the sensed vehicle conditions and occupant conditions. The controller 20 compares the outputs of the sensors 14 and 16 with outputs found in a look-up table, for example. Depending on the outcome of this comparison, the controller 20 determines whether or not to adjust the preset viscosity of the fluid 52, to prevent or minimize injury to the driver caused by the brake pedal 30.

In most such crash conditions, it is desirable that the brake pedal 30 be movable relative to the actuating member 36 under driver load. It is also desirable that as much as possible of the movement of the brake pedal 30 be used to absorb the kinetic energy of the driver. Thus, the controller 20 preferably adjusts the viscosity of the fluid 52 to meet this goal.

For example, in the event of a sensed crash condition of relatively low severity, the driver will have a relatively low amount of kinetic energy (moving in a direction relative to and toward the brake pedal 30) to be absorbed by the energy absorbing device 50. Therefore, the energy absorbing device 50 can resist in a relatively weak manner the movement of the brake pedal 30 under driver load, and still absorb most or all of the kinetic energy of the driver. To achieve this result, the controller 20 can cause the strength of the magnetic field generated by the coil 56 to be decreased substantially. This decrease in the magnetic field strength lowers the viscosity of the fluid 52 substantially, and thus decreases substantially the resistance to movement of the brake pedal 30 relative to the actuating member 36 under load applied by the driver's foot.

Alternatively, in the event of a sensed crash condition of relatively high severity, the driver will have a relatively large amount of kinetic energy to be absorbed by the energy absorbing device 50. Therefore, the release mechanism 40 needs to resist in a relatively strong manner the movement of the brake pedal 30 under driver load, in order to absorb most or all of the kinetic energy of the driver. To achieve this result, the controller 20 can cause the strength of the magnetic field generated by the coil 56 to be decreased by a relatively small amount. This relatively small decrease in the magnetic field strength causes the fluid 52 to decrease in viscosity by a relatively small amount. The relatively small decrease in viscosity thus decreases by only a small amount the resistance to movement of the brake pedal 30 relative to the actuating member 36 under load applied by the driver's foot. The brake pedal 30 moves but does so with a relatively strong resistance, thus absorbing more kinetic energy of the driver.

As another example, the controller 20 determines at the onset of the crash event whether to change the preset condition of the fluid 52 on the basis of sensed occupant conditions. For example, if the driver is relatively heavy, the controller 20 can in response decrease by a small amount the strength of the magnetic field generated by the coil 56. This causes the fluid 52 to decrease in viscosity, making it easier for the piston 70 to move axially through the fluid 52 in the cylinder 54. This decreases by only a small amount the resistance to movement of the brake pedal 30 relative to the actuating member 36 under load applied by the driver's foot. Similarly, if the occupant condition sensors 16 indicate that the driver is relatively light weight, then the controller 20 can decrease substantially the strength of the magnetic field generated by the coil 56. This will decrease substantially the resistance to movement of the brake pedal 30 relative to the actuating member 36 under load applied by the driver's foot.

The present invention provides the ability to select the time at which the brake pedal 30 is released for forward movement in the vehicle 12. For example, the release mechanism 40 can be actuated at a relatively early time during the vehicle collision, if a determination based on the outputs of the occupant position sensors 16 indicates that to be desirable. Alternatively, the controller 20 may take additional time to analyze the vehicle event in order to determine whether the release mechanism 40 should be actuated. The determination may thus be made on the basis of information arriving at the controller after the vehicle collision is first sensed. At a later point in the event, when the vehicle crash pulse is near its highest severity, the brake pedal 30 is released, thus clipping the peak forces acting between the brake pedal and the driver's foot during the most aggressive part of the crash event. The vehicle electric circuitry 20 can also be programmed not to actuate the release mechanism 40 under some circumstances.

The present invention also provides the ability to have the vehicle braking system operable after an event in which the brake pedal 30 is released. Specifically, when the piston 70 reaches the end of the cylinder 54, the actuating member 36 is again movable with the brake pedal 30, and thus the vehicle operator is able to retain the braking function of the vehicle 12.

Figure 3:
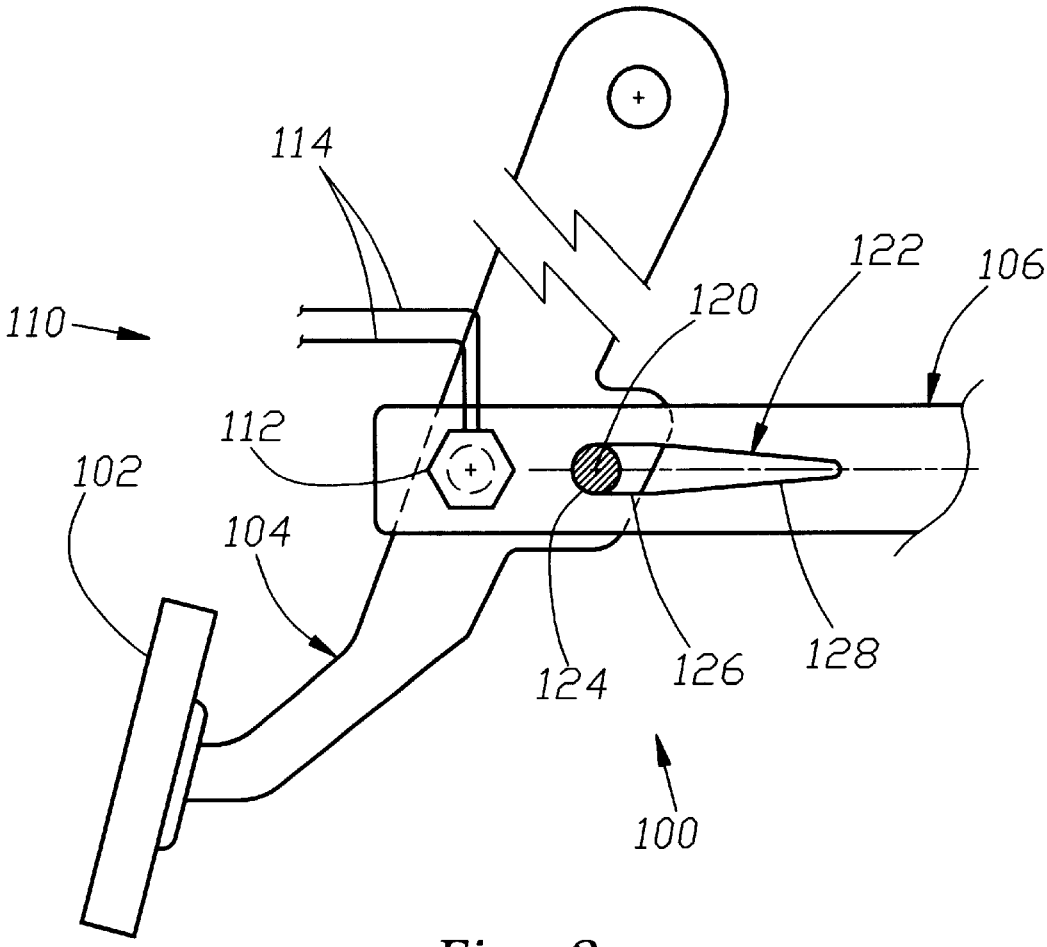
FIG. 3 is a schematic side view of a portion of an apparatus for actuating a braking system of a vehicle in accordance with a second embodiment of the invention.

FIG. 3 illustrates an apparatus 100 for actuating a braking mechanism of a vehicle, constructed in accordance with a second embodiment of the invention. The apparatus 100 includes a different actuating member and energy absorbing device than are used in the apparatus 10, but may otherwise be usable in the vehicle 12 including other components of the apparatus 10.

The apparatus 100 includes a brake pedal 102 fixedly supported on a brake lever 104. The brake lever 104 is supported on the vehicle for pivotal movement relative to the vehicle 12. The brake pedal 102 is engageable by a foot of the vehicle driver to effect actuation of the vehicle braking system, in a manner described below.

The apparatus 100 also includes an actuating member 106, which is a rigid plate or other structure made from metal or a hard plastic. The actuating member 106 is connected, in a manner not shown, with the vehicle braking system and is movable to actuate the vehicle braking system. When the actuating member 106 is moved in a direction to the right as viewed in FIG. 3, the vehicle braking system is actuated.

The apparatus 100 includes a release mechanism 110 connected between the brake pedal 102 and the actuating member 106. The release mechanism 110 includes an actuatable fastener that is preferably a pyrotechnic fastener in the form of a pyrotechnic rivet 112. The pyrotechnic rivet 112 is connected between the brake lever 104 and the actuating member 106. Lead wires 114 extend from the pyrotechnic rivet 112 and are connected with electric circuitry of the vehicle 12 including the sensors 14 and 16 (FIG. 1) and the controller 20.

The pyrotechnic rivet 112 (FIG. 3) is a known device that is electrically actuatable by a signal received over the lead wires 114. The pyrotechnic rivet 112, when unactuated, connects the brake lever 104, and thereby the brake pedal 102, to the actuating member 106. Upon actuation, the pyrotechnic rivet 112 fractures, enabling movement of the brake lever 104, and thereby the brake pedal 102, relative to the actuating member 106. The pyrotechnic rivet 112 is shown in an unactuated condition in FIG. 3.

The release mechanism 112 also includes a pin 120 fixed to and movable with the brake lever 104. The pin 120 is received in a slot 122 in the actuating member 106. The slot 122 has a relatively large first end portion 124 in which the pin 120 is located when the release mechanism 110 is in the unactuated condition shown in FIG. 3. The slot 122 has a constant width portion 126 extending from the first end portion 124. The slot 122 has an elongate second end portion 128, which tapers in width from the diameter of the pin 120 to a substantially smaller width.

The material of the actuating member 106 is plastically deformable to resist movement of the pin 120 in the slot 122 and thereby to absorb energy. The configuration of the slot 122 and the material of the actuating member 106 determine the amount of force that is necessary to move the brake pedal 102 relative to the actuating member 106 when the brake pedal is released for movement.

In the event of a vehicle collision, or other event for which protection of the vehicle driver may be desired, the controller 20 determines whether to actuate the pyrotechnic rivet 112. If the controller 20 determines that it is desirable to allow the brake pedal 102 to move forward in the vehicle 12 under the load applied by the driver, the controller 20 sends an actuation signal over the lead wires 114 to the pyrotechnic rivet 112. The pyrotechnic rivet 112 is actuated and fractures. The brake lever 104, the brake pedal 102 and the pin 120 are thus released for movement relative to the actuating member 106. When the load applied to the brake pedal 102 by the driver's foot exceeds the resistance of the material of the actuating member 106, the pin 120 moves forward in the slot 122 and the actuating member undergoes plastic deformation. This deformation resists the movement of the pin 120 in the slot 122, thus absorbing energy of the relative movement between the brake pedal 102 and the actuating member 106. When the brake pedal 102 moves relative to the actuating member 106, the brake pedal presents less resistance to the driver's foot, and the maximum effective load on the driver's foot is limited.

Figure 4:
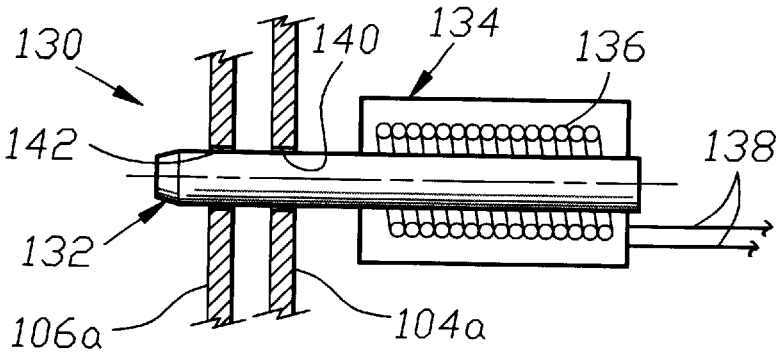
FIG. 4 is a schematic side view of a portion of an apparatus for actuating a braking system of a vehicle in accordance with a third embodiment of the invention.

FIG. 4 illustrates a portion of an apparatus 130 for actuating a braking mechanism of a vehicle, constructed in accordance with a third embodiment of the invention. The apparatus 130 is similar in construction and operation to the apparatus 110 (FIG. 3). Parts of the apparatus 130 that are the same as parts of the apparatus 110 are given the same reference numerals, with the suffix "a" added to distinguish them.

The apparatus 130 includes an actuatable fastener in the form of a solenoid pin 132, rather than the pyrotechnic rivet 112 (FIG. 3). The solenoid pin 132 is part of a solenoid shown schematically at 134. The solenoid 134 includes a coil 136 surrounding the pin 132. Lead wires 138 extend from the coil 136 and are connected with electric circuitry of the vehicle such as the controller 20 (FIG. 1).

The pin 132 extends through an opening 140 in a brake lever 104*a* and through an opening 142 in an actuating member 106*a*. When the solenoid 134 is unactuated, the pin 132 connects, or fastens, the actuating member 106*a* to the brake lever 104*a* for movement with the brake lever.

In the event of a vehicle collision, or other event for which protection of the vehicle driver may be desired, the solenoid 134 is energized, and the pin 132 moves out of the opening 142 in the actuating member 106*a*. The brake lever 104*a* is thus released for movement relative to the actuating member 106*a*, to present less resistance to the driver's foot, as described above with reference to FIG. 3.

Figure 5:
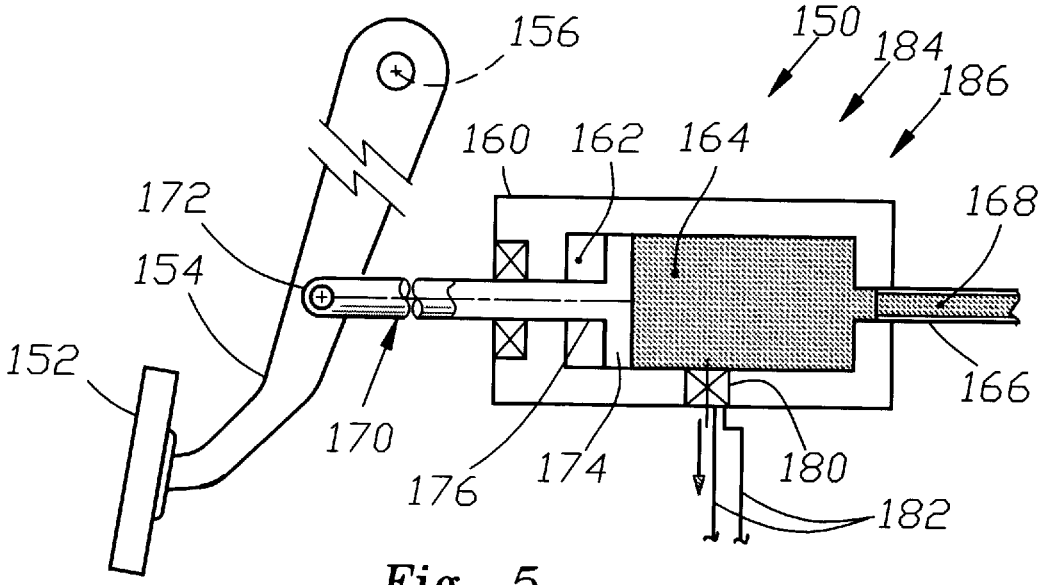
FIG. 5 is a schematic side view of a portion of an apparatus for actuating a braking system of a vehicle in accordance with a fourth embodiment of the invention.

FIG. 5 illustrates an apparatus 150 for actuating a braking mechanism of a vehicle, constructed in accordance with a fourth embodiment of the invention. The apparatus 150 includes a brake pedal 152 fixedly supported on a brake lever 154. The brake lever 154 is supported on the vehicle for pivotal movement relative to the vehicle about an axis 156. The brake pedal 152 is thus supported on the vehicle for movement between a plurality of positions. The brake pedal 152 is engageable by a foot of the vehicle driver to effect actuation of the vehicle braking system, in a manner described below.

The apparatus 150 also includes a cylinder 160 defining a chamber 162. A quantity of brake fluid 164 is contained in the chamber 162. A brake line 166 extends from the cylinder 160 to a brake mechanism (not shown) of the vehicle located at one or more of the wheels of the vehicle. The brake line 166 is filled with a quantity of brake fluid 168. The brake line 166 is in fluid communication with the chamber 162 in the cylinder 160, and the brake fluid 168 in the brake line is contiguous with the brake fluid 164 in the cylinder. The brake fluid 168 in the brake line 166 forms an actuating member for the braking system of the vehicle.

The apparatus 150 further includes a shaft 170. A first end portion 172 of the shaft 170 is connected with the brake lever 154 for pivotal movement relative to the brake lever. A piston 174 is fixed on a second end portion 176 of the shaft 170. The piston 174 is located in the cylinder 160 and is slidable in the cylinder in response to movement of the brake pedal 152 and the brake lever 154.

An orifice assembly indicated schematically at 180 is located in the cylinder 160. The orifice assembly 180 is an electrically actuatable fluid venting device connected by lead wires 182 to a controller, which may be the controller 20 (FIG. 1). The controller controls the operation of the orifice assembly 180 in response to the outputs of the vehicle condition sensors 14 and the occupant condition sensors 20. The orifice assembly 180 forms part of an energy absorbing device 184 and a release mechanism 186 of the apparatus 150.

The orifice assembly 180 has a first condition, or closed condition, in which brake fluid 164 cannot flow out of the cylinder 160 through the orifice assembly. When the orifice assembly 180 is in the first condition, movement of the piston 174 in the cylinder 160 (to the right as viewed in FIG. 5) causes the brake fluid 168 in the brake line 166 to move in a direction toward the brake mechanism of the vehicle. As a result, when the vehicle driver depresses the brake pedal 152, the shaft 170 causes the actuating member 168 to move in a direction to actuate the vehicle braking system, that is, to the right as viewed in FIG. 5. Thus, the actuating member 168 moves with the brake pedal 152 under load applied to the brake pedal by the vehicle occupant.

The orifice assembly 180 has a second condition, or open condition, in which brake fluid 164 can flow out of the cylinder 160 through the orifice assembly. Specifically, in the event of a crash condition as described above, the controller opens the orifice assembly 180, allowing brake fluid 164 to vent from the chamber 162 in the cylinder 160. Movement of the piston 174 in the cylinder 160 causes brake fluid 164 to be forced out of the orifice assembly 180, without forcing fluid out of the cylinder through the brake line 166. Thus, the brake pedal 152 can move relative to the actuating member 168 under load applied by the driver's foot.

When the piston 174 reaches the location of the orifice assembly 180, the piston blocks fluid flow out of the cylinder 160 through the orifice assembly. The actuating member 168 is again movable with the brake pedal 154, and thus the vehicle operator is able to retain the braking function of the vehicle 12.

Figure 6:
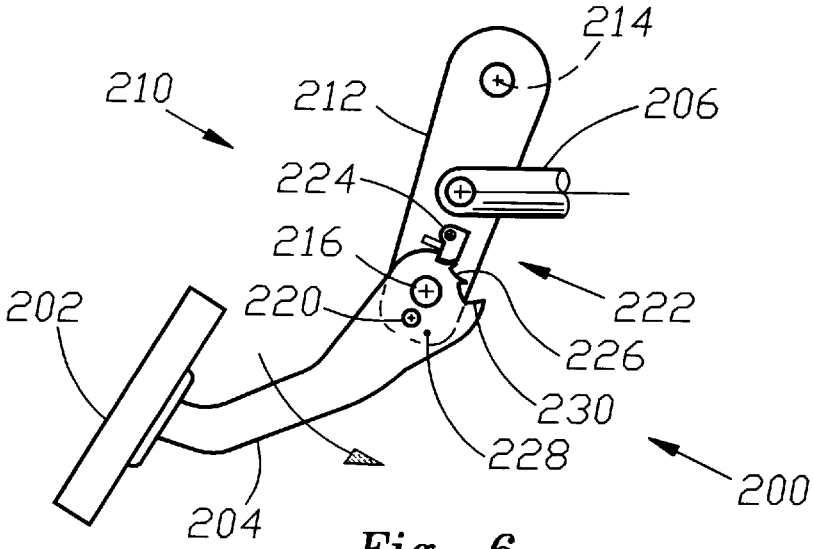
FIG. 6 is a schematic side view of a portion of an apparatus for actuating a braking system of a vehicle in accordance with a fifth embodiment of the invention.

FIG. 6 illustrates an apparatus 200 for actuating a braking mechanism of a vehicle, constructed in accordance with a fifth embodiment of the invention. The apparatus 200 includes a brake pedal 202 fixedly supported on a brake lever 204. The apparatus 200 also includes an actuating member 206, which is connected, in a manner not shown, with the vehicle braking system and is movable to actuate the vehicle braking system. When the actuating member 206 is moved in a direction to the right as viewed in FIG. 6, the vehicle braking system is actuated.

The apparatus 200 includes a release mechanism 210 connected between the brake lever 204 and the actuating member 206. The release mechanism 210 includes a pivot arm 212 supported on the vehicle for pivotal movement relative to the vehicle about an axis 214. A pivot pin 216 pivotally interconnects the brake lever 204 and the pivot arm 212. The actuating member 206 extends from the pivot arm 212 and is movable in response to movement of the pivot arm.

The release mechanism 210 includes an actuatable fastener 220 that rigidly interconnects the brake lever 204 and the pivot arm 212, at a location spaced apart from the pivot pin 216. The actuatable fastener 220 may be a pyrotechnic fastener of the type described above with reference to FIG. 3 or a solenoid pin of the type described above with reference to FIG. 4.

The release mechanism 210 includes a pawl and ratchet mechanism 222. The mechanism 222 includes a pawl 224 mounted on the pivot arm 212, and a ratchet 226 formed on an end portion 228 of the brake lever 204 radially outward of the actuatable fastener 220. The pawl 224 is in engagement with the ratchet 226.

The actuatable fastener 220 has an unactuated condition connecting the brake lever 204 and the pivot arm 212 for movement with each other. The brake pedal 202 is engageable by a foot of the vehicle driver to move the pivot arm 212 and thus to effect actuation of the vehicle braking system.

In the event of a vehicle collision, or other event for which protection of the vehicle driver may be desired, the actuatable fastener 220 is actuated. Actuation of the actuatable fastener 220 releases the brake lever 204 and the brake pedal 202 for pivotal movement relative to the pivot arm 212 about the pivot pin 216.

The pawl and ratchet mechanism 222 applies resistance to pivotal movement of the brake lever 204. When the load applied to the brake pedal 202 by the driver's foot exceeds the resistance of the pawl and ratchet mechanism 222, the brake lever 204 pivots downward as viewed in FIG. 6 about the pivot pin 216. The ratcheting action of the pawl and ratchet mechanism 222 absorbs energy during the relative movement between the brake pedal 204 and the pivot arm 212. As the brake pedal 204 moves relative to the actuating member 206, the brake pedal presents less resistance to the driver's foot, and the maximum effective load on the driver's foot is limited.

After a predetermined amount of movement of the brake lever 204 relative to the pivot arm 212, the pawl 224 engages a stop tooth 230 on the brake lever. The engagement of the pawl 224 with the stop tooth 230 blocks further pivotal movement of the brake lever 204 relative to the pivot arm 212. The brake lever 204 is again movable with the pivot arm 212, and the vehicle braking system is usable by the vehicle driver.

From the above description of the invention, those skilled in the art will perceive improvements, changes and modifications in the invention. Such improvements, changes and modifications within the skill of the art are intended to be covered by the appended claims.

Having described the invention, we claim:

1. An apparatus for actuating a braking system of a vehicle, said apparatus comprising:

a brake pedal supported on the vehicle for movement between a plurality of positions and engageable by a foot of the vehicle occupant to effect actuation of the braking system;

an actuating member movable to actuate the braking system;

a release mechanism connected between said brake pedal and said actuating member, said release mechanism having a first condition connecting said actuating member for movement with said brake pedal, said release mechanism having a second condition releasing said brake pedal for movement relative to said actuating member under load applied to said brake pedal by the vehicle occupant, said release mechanism when in said second condition resisting movement of said brake pedal relative to said actuating member;

at least one sensor operative to sense a vehicle condition or an occupant condition and to provide a first output signal; and a controller for receiving said first output signal and for in response controlling said release mechanism to control the resistance of said release mechanism to movement of said brake pedal relative to said actuating member.

2. An apparatus as set forth in claim 1 wherein said sensed vehicle condition is crash severity, and said controller determines when to actuate said release mechanism based on sensed crash severity.

3. An apparatus as set forth in claim 1 wherein said controller determines when to actuate said release mechanism based on multiple sensed occupant conditions.

4. An apparatus as set forth in claim 1 wherein said sensor senses occupant seat belt usage, size, weight, and/or position.

5. An apparatus as set forth in claim 1 wherein said release mechanism comprises an energy absorbing device interposed between said brake pedal and said actuating member for resisting movement of said brake pedal relative to said actuating member, said energy absorbing device comprising a fluid having a viscosity that varies in response to an energy field acting on said fluid, said controller being operative to vary the viscosity of said fluid by varying said energy field to vary the resistance to movement of said brake pedal relative to said actuating member.

6. An apparatus as set forth in claim 5 wherein said fluid is a magneto-rheological fluid.

7. An apparatus as set forth in claim 6 including a coil adjacent said fluid, said coil producing a magnetic field controlled by said controller, said magnetic field controlling the viscosity of said fluid.

8. An apparatus as set forth in claim 5 wherein said fluid is an electro-rheological fluid.

9. An apparatus as set forth in claim 5 wherein said sensed vehicle condition is crash severity, said sensed occupant condition is occupant seat belt usage, size, weight, and/or position, and said controller determines when to actuate said release mechanism based on sensed crash severity and/or on multiple sensed occupant conditions.

10. An apparatus as set forth in claim 1 wherein said release mechanism comprises at least one electrically actuatable fastener connected between said brake pedal and said actuating member, said actuatable fastener having an unactuated condition connecting said actuating member for movement with said brake pedal, said actuatable fastener having an actuated condition releasing said brake pedal for movement in a forward direction in the vehicle relative to said actuating member under load applied to said brake pedal by the vehicle occupant.

11. An apparatus as set forth in claim 10 wherein said actuatable fastener is a pyrotechnic fastener.

12. An apparatus as set forth in claim 11 wherein said pyrotechnic fastener is a pyrotechnic rivet.

13. An apparatus as set forth in claim 10 wherein said actuatable fastener comprises an electrically actuatable solenoid having a pin movable upon actuation of said solenoid from a first position connecting said actuating member for movement with said brake pedal to a second condition releasing said brake pedal for movement relative to said actuating member under load applied to said brake pedal by the vehicle occupant.

14. An apparatus as set forth in claim 1 wherein said actuating member has a tapered slot and said release mechanism comprises a member movable in said tapered slot upon actuation of said release mechanism to resist movement of said brake pedal relative to said actuating member under load applied to said brake pedal by the vehicle occupant.

15. An apparatus as set forth in claim 1 wherein:

the vehicle braking system comprises a cylinder containing brake fluid, a conduit extending from said cylinder to a brake assembly, and a piston movable in said cylinder in response to movement of said brake pedal to direct brake fluid from said cylinder through said conduit in a direction toward the brake assembly;

said actuating member comprises a quantity of brake fluid in said conduit; and said release mechanism comprises an orifice in said cylinder that opens upon actuation of said release mechanism to vent brake fluid from said cylinder to enable movement of said piston in said cylinder without causing movement of said brake fluid in said conduit in a direction toward the brake assembly.

16. An apparatus as set forth in claim 15 wherein said orifice closes after a predetermined amount of movement of said brake pedal in said cylinder.

17. An apparatus as set forth in claim 1 wherein said release mechanism comprises a pawl and a ratchet both interposed between said brake pedal and said actuating member resisting movement of said brake pedal relative to said actuating member, said ratchet having a stop for limiting movement of said brake pedal relative to said ratchet.

18. An apparatus as set forth in claim 1 wherein said release mechanism comprises a pawl and a ratchet both interposed between said brake pedal and said actuating member resisting movement of said brake pedal relative to said actuating member, said ratchet having a stop for limiting movement of said brake pedal relative to said ratchet.

19. An apparatus for actuating a braking system of a vehicle, said apparatus comprising:

a brake pedal supported on the vehicle for movement between a plurality of positions and engageable by a foot of the vehicle occupant to effect actuation of the braking system;

an actuating member movable to actuate the braking system;

a release mechanism connected between said brake pedal and said actuating member, said release mechanism having a first condition connecting said actuating member for movement with said brake pedal, said release mechanism having a second condition releasing said brake pedal for movement relative to said actuating member under load applied to said brake pedal by the vehicle occupant, said release mechanism when in said second condition resisting movement of said brake pedal relative to said actuating member;

at least one sensor operative to sense a vehicle condition or an occupant condition and to provide a first output signal; and a controller for receiving said first output signal and for in response controlling said release mechanism to control the resistance of said release mechanism to movement of said brake pedal relative to said actuating member, said controller determining when to actuate said release mechanism based on multiple sensed occupant conditions.

20. An apparatus as set forth in claim 19 wherein said release mechanism comprises an energy absorbing device interposed between said brake pedal and said actuating member for resisting movement of said brake pedal relative to said actuating member, said energy absorbing device comprising a fluid having a viscosity that varies in response to an energy field acting on said fluid, said controller being operative to vary the viscosity of said fluid by varying said energy field to vary the resistance to movement of said brake pedal relative to said actuating member.

21. An apparatus as set forth in claim 20 wherein said fluid is a magneto-rheological fluid.

22. An apparatus as set forth in claim 21 including a coil adjacent said fluid, said coil producing a magnetic field controlled by said controller, said magnetic field controlling the viscosity of said fluid.

23. An apparatus as set forth in claim 20 wherein said fluid is an electro-rheological fluid.

24. An apparatus as set forth in claim 20 wherein said sensed vehicle condition is crash severity, said multiple sensed occupant conditions are occupant seat belt usage, size, weight, and/or position, and said controller determines when to actuate said release mechanism based on sensed crash severity and/or on said multiple sensed occupant conditions.

25. An apparatus as set forth in claim 19 wherein said release mechanism comprises at least one electrically actuatable fastener connected between said brake pedal and said actuating member, said actuatable fastener having an unactuated condition connecting said actuating member for movement with said brake pedal, said actuatable fastener having an actuated condition releasing said brake pedal for movement in a forward direction in the vehicle relative to said actuating member under load applied to said brake pedal by the vehicle occupant.

26. An apparatus as set forth in claim 25 wherein said actuatable fastener is a pyrotechnic fastener.

27. An apparatus as set forth in claim 24 wherein said pyrotechnic fastener is a pyrotechnic rivet.

28. An apparatus as set forth in claim 25 wherein said actuatable fastener comprises an electrically actuatable solenoid having a pin movable upon actuation of said solenoid from a first position connecting said actuating member for movement with said brake pedal to a second condition releasing said brake pedal for movement relative to said actuating member under load applied to said brake pedal by the vehicle occupant.

29. An apparatus as set forth in claim 19 wherein said actuating member has a tapered slot and said release mechanism comprises a member movable in said tapered slot upon actuation of said release mechanism to resist movement of said brake pedal relative to said actuating member under load applied to said brake pedal by the vehicle occupant.

30. An apparatus as set forth in claim 19 wherein:

the vehicle braking system comprises a cylinder containing brake fluid, a conduit extending from said cylinder to a brake assembly, and a piston movable in said cylinder in response to movement of said brake pedal to direct brake fluid from said cylinder through said conduit in a direction toward the brake assembly;

said actuating member comprises a quantity of brake fluid in said conduit; and said release mechanism comprises an orifice in said cylinder that opens upon actuation of said release mechanism to vent brake fluid from said cylinder to enable movement of said piston in said cylinder without causing movement of said brake fluid in said conduit in a direction toward the brake assembly.

31. An apparatus as set forth in claim 30 wherein said orifice closes after a predetermined amount of movement of said brake pedal in said cylinder.

32. An apparatus for actuating a braking system of a vehicle, said apparatus comprising:

a brake pedal supported on the vehicle for movement between a plurality of positions and engageable by a foot of the vehicle occupant to effect actuation of the braking system;

an actuating member movable to actuate the braking system;

a release mechanism connected between said brake pedal and said actuating member, said release mechanism having a first condition connecting said actuating member for movement with said brake pedal, said release mechanism having a second condition releasing said brake pedal for movement relative to said actuating member under load applied to said brake pedal by the vehicle occupant, said release mechanism when in said second condition resisting movement of said brake pedal relative to said actuating member;

at least one sensor operative to sense a vehicle condition or an occupant condition and to provide a first output signal; and a controller for receiving said first output signal and for in response controlling said release mechanism to control the resistance of said release mechanism to movement of said brake pedal relative to said actuating member, said at least one sensor sensing occupant seat belt usage, size, weight, and/or position.

33. An apparatus as set forth in claim 32 wherein said release mechanism comprises an energy absorbing device interposed between said brake pedal and said actuating member for resisting movement of said brake pedal relative to said actuating member, said energy absorbing device comprising a fluid having a viscosity that varies in response to an energy field acting on said fluid, said controller being operative to vary the viscosity of said fluid by varying said energy field to vary the resistance to movement of said brake pedal relative to said actuating member.

34. An apparatus as set forth in claim 33 wherein said fluid is a magneto-rheological fluid.

35. An apparatus as set forth in claim 34 including a coil adjacent said fluid, said coil producing a magnetic field controlled by said controller, said magnetic field controlling the viscosity of said fluid.

36. An apparatus as set forth in claim 33 wherein said fluid is an electro-rheological fluid.

37. An apparatus as set forth in claim 33 wherein said sensed vehicle condition is crash severity and said controller determines when to actuate said release mechanism based on sensed crash severity and/or on said multiple sensed occupant conditions.

38. An apparatus as set forth in claim 32 wherein said release mechanism comprises at least one electrically actuatable fastener connected between said brake pedal and said actuating member, said actuatable fastener having an unactuated condition connecting said actuating member for movement with said brake pedal, said actuatable fastener having an actuated condition releasing said brake pedal for movement in a forward direction in the vehicle relative to said actuating member under load applied to said brake pedal by the vehicle occupant.

39. An apparatus as set forth in claim 38 wherein said actuatable fastener is a pyrotechnic fastener.

40. An apparatus as set forth in claim 39 wherein said pyrotechnic fastener is a pyrotechnic rivet.

41. An apparatus as set forth in claim 38 wherein said actuatable fastener comprises an electrically actuatable solenoid having a pin movable upon actuation of said solenoid from a first position connecting said actuating member for movement with said brake pedal to a second condition releasing said brake pedal for movement relative to said actuating member under load applied to said brake pedal by the vehicle occupant.

42. An apparatus as set forth in claim 32 wherein said actuating member has a tapered slot and said release mechanism comprises a member movable in said tapered slot upon actuation of said release mechanism to resist movement of said brake pedal relative to said actuating member under load applied to said brake pedal by the vehicle occupant.

43. An apparatus as set forth in claim 32 wherein:

the vehicle braking system comprises a cylinder containing brake fluid, a conduit extending from said cylinder to a brake assembly, and a piston movable in said cylinder in response to movement of said brake pedal to direct brake fluid from said cylinder through said conduit in a direction toward the brake assembly;

said actuating member comprises a quantity of brake fluid in said conduit; and said release mechanism comprises an orifice in said cylinder that opens upon actuation of said release mechanism to vent brake fluid from said cylinder to enable movement of said piston in said cylinder without causing movement of said brake fluid in said conduit in a direction toward the brake assembly.

44. An apparatus as set forth in claim 43 wherein said orifice closes after a predetermined amount of movement of said brake pedal in said cylinder.

45. An apparatus as set forth in claim 32 wherein said release mechanism comprises a pawl and a ratchet both interposed between said brake pedal and said actuating member resisting movement of said brake pedal relative to said actuating member, said ratchet having a stop for limiting movement of said brake pedal relative to said ratchet.

* * * * *

UNITED STATES PATENT AND TRADEMARK OFFICE

CERTIFICATE OF CORRECTION

PATENT NO. : 6,679,135 B1 
DATED : January 20, 2004
INVENTOR(S) : Ernst M. Faigle, Thomas Osentoski and Tracy S. Sparks It is certified that error appears in the above-identified patent and that said Letters Patent is hereby corrected as shown below:

Column 12,
Line 3, after "claim" change "24" to -- 26 --.

Signed and Sealed this

Twenty-ninth Day of June, 2004

JON W. DUDAS
*Acting Director of the United States Patent and Trademark Office*